US008757112B2

(12) United States Patent
Lee et al.

(10) Patent No.: US 8,757,112 B2
(45) Date of Patent: Jun. 24, 2014

(54) VARIABLE COMPRESSION RATIO APPARATUS

(71) Applicant: Hyundai Motor Company, Seoul (KR)

(72) Inventors: Eun Ho Lee, Suwon-si (KR); Jin Kook Kong, Suwon-si (KR); Dong Seok Lee, Suwon-si (KR); Soo Hyung Woo, Yongin-si (KR); Yoonsik Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 14 days.

(21) Appl. No.: 13/712,100

(22) Filed: Dec. 12, 2012

(65) Prior Publication Data

US 2014/0014070 A1 Jan. 16, 2014

(30) Foreign Application Priority Data

Jul. 11, 2012 (KR) ..... 10-2012-0075761

(51) Int. Cl.
*F02B 75/04* (2006.01)

(52) U.S. Cl.
USPC ..... 123/48 B; 123/78 R; 123/197.1

(58) Field of Classification Search
CPC .... F02B 75/047; F02B 75/048; F02B 75/045; F02D 15/00
USPC ..... 123/48 B, 48 R, 78 R, 78 E, 78 F, 197.1, 123/197.3, 197.4; 74/586
See application file for complete search history.

(56) References Cited

U.S. PATENT DOCUMENTS

| | | | | |
|---|---|---|---|---|
| 8,397,684 | B2 * | 3/2013 | Yang et al. | 123/48 R |
| 2010/0180868 | A1 * | 7/2010 | Scalzo | 123/48 B |
| 2012/0000444 | A1 * | 1/2012 | Yang et al. | 123/48 B |
| 2012/0125297 | A1 * | 5/2012 | Lee et al. | 123/48 B |

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A variable compression ratio apparatus mounted on an engine may include an eccentric bearing assembly engaged with the piston through a piston pin, and including an eccentric ring having an eccentric hole so that the piston pin may be rotatably installed therethrough while being eccentric to the eccentric ring, and an eccentric link connected to the eccentric ring to transfer rotation force to the eccentric ring, a first connecting rod rotatably installed at an one side in an axial direction of the eccentric ring, a second connecting rod rotatably installed at the other side in the axial direction of the eccentric ring, and a control shaft connected to the eccentric link to rotate the eccentric bearing assembly by transferring the rotation force to the eccentric ring.

11 Claims, 9 Drawing Sheets

VARIABLE COMPRESSION RATIO APPARATUS

CROSS-REFERENCE TO RELATED APPLICATION

The present application claims priority to Korean Patent Application No. 10-2012-0075761 filed on Jul. 11, 2012, the entire contents of which is incorporated herein for all purposes by this reference.

BACKGROUND OF THE INVENTION

1. Field of the Invention

The present invention relates to a variable compression ratio apparatus, and more particularly, to a variable compression ratio apparatus for varying a compression ratio of mixed gas inside a combustion chamber according to an operation condition of an engine.

2. Description of Related Art

In general, thermal efficiency of a heat engine is increased when a compression ratio is high, and thermal efficiency of a spark ignition engine is increased when an ignition timing is advanced up to a predetermined level. However, when the ignition timing is advanced in a high compression ratio, abnormal combustion may be generated in the spark ignition engine, which causes damage to an engine, such that there is a limit in the advance of the ignition timing and thus it is necessary to bear output deterioration.

The variable compression ratio (VCR) apparatus is an apparatus for changing a compression ratio of mixed gas according to an operation condition of an engine. According to the variable compression ratio apparatus, fuel efficiency is improved by increasing the compression ratio of the mixed gas in a low load condition of an engine, and a generation of knocking is prevented and an engine output is improved by decreasing the compression ratio of the mixed gas in a high load condition of an engine.

In the variable compression ratio apparatus in the related art, a change in a compression ratio is implemented by changing a length of a connecting rod for connecting a piston and a crankshaft. Such a type of variable compression ratio apparatus, a part for connecting the piston and the crankshaft includes a plurality of links, so that combustion pressure is directly transferred to the links. Accordingly, durability of the links deteriorates.

Accordingly, a method of separately connecting the crankshaft to the piston without directly installing the variable compression ratio apparatus on the crankshaft has been researched. As a result of various experiments for the variable compression ratio apparatus, an apparatus of changing a compression ratio by using an eccentric bearing has attracted attention due to high operational stability. However, there is a problem in that it is difficult to combine the links for rotating the eccentric bearing without disturbing the rotation when considering a position and an operation condition of the crankshaft.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio apparatus for effectively varying a compression ratio Further, various aspects of the present invention are directed to providing a variable compression ratio apparatus having a simple structure and a simple assembling process.

In addition, various aspects of the present invention are directed to providing a variable compression ratio apparatus which is effectively operated without disturbing the rotation of a crankshaft.

In an aspect of the present invention, a variable compression ratio apparatus mounted on an engine receiving combustion force of mixed gas from a piston to rotate a crankshaft, and configured to change a compression ratio of the mixed gas may include an eccentric bearing assembly engaged with the piston through a piston pin, and including an eccentric ring having an eccentric hole so that the piston pin is rotatably installed therethrough while being eccentric to the eccentric ring, and an eccentric link connected to the eccentric ring to transfer rotation force to the eccentric ring, a first connecting rod rotatably installed at an one side in an axial direction of the eccentric ring, a second connecting rod rotatably installed at the other side in the axial direction of the eccentric ring, and a control shaft connected to the eccentric link to rotate the eccentric bearing assembly by transferring the rotation force to the eccentric ring, wherein the eccentric ring may include expanded portions at both sides in the axial direction thereof so that the first and second connecting rods are rotatably installed at the expanded portions, respectively, and wherein one ends of the first and second connecting rods are formed with mounting holes respectively, the expanded portions being rotatably inserted therein, and the other ends of the first and second connecting rods are rotatably connected to the crankshaft while being eccentric to the crankshaft.

The eccentric ring is integrally formed with the eccentric link.

The eccentric ring is separately provided from the eccentric link to be coupled with the eccentric link.

An insertion opening passing through in a circular shape is formed at one end of the eccentric link, so that the eccentric ring is inserted in and coupled with the insertion opening.

The eccentric link may include a first eccentric link connected to the eccentric ring, a second eccentric link connected to the control shaft, and a third eccentric link pivotally connecting the first eccentric link and the second eccentric link.

A first link hole is formed at an end of the first eccentric link opposite to the eccentric ring, and a second link hole is formed at an end of the third eccentric link, wherein the first eccentric link is pivotally coupled with the third eccentric link by a first shaft member inserted in both the first link hole and the second link hole.

The end of the first eccentric link is branched and formed as a pair of plates facing each other with a predetermined interval, and first link holes are formed at the pair of plates, respectively, wherein the end of the third eccentric link is inserted in the interval between the pair of plates, and the first shaft member is inserted in the first link holes and the second link hole to be coupled with the end of the first eccentric link.

A third link hole is formed at an end of the second eccentric link opposite to the control shaft, and a fourth link hole is formed at the other end of the third eccentric link, wherein the second eccentric link is pivotally coupled with the third eccentric link by a second shaft member inserted in both the third link hole and the fourth link hole.

The other end of the third eccentric link is branched and formed as a pair of branched portions facing each other with a predetermined interval, and fourth link holes are formed at the pair of branched portions, respectively, wherein the end of the second eccentric link is inserted in the interval between the pair of branched portions, and the second shaft member is inserted in the third link hole and the fourth link hole to be coupled with the other end of the third eccentric link.

In another aspect of the present invention, a variable compression ratio apparatus configured to change a compression ratio of mixed gas flowing in a cylinder of an engine according to an operation condition of the engine, may include a piston slidably moving inside the cylinder, a crankshaft provided at a lower end of the cylinder to be rotated by a reciprocal movement of the piston, a balance weight connected to the crank shaft and configured to reduce vibration generated during a rotation of the crank shaft, an eccentric ring engaged with the piston through a piston pin, and including an eccentric hole formed therein so that the piston pin is rotatably installed therethrough while being eccentric to the eccentric ring, an eccentric link connected with the eccentric ring to transfer rotation force to the eccentric ring, a first connecting rod rotatably installed at an one side in an axial direction of the eccentric ring, a second connecting rod rotatably installed at the other side in the axial direction of the eccentric ring, and a control shaft pivotally connected to the eccentric link to rotate the eccentric ring, wherein one ends of the first and second connecting rods are formed with mounting holes respectively, the expanded portions being rotatably inserted therein, and the other ends of the first and second connecting rods are rotatably connected to the crankshaft while being eccentric to the crankshaft.

The eccentric link may include a first eccentric link connected to the eccentric ring, a second eccentric link connected to the control shaft, and a third eccentric link pivotally connecting the first eccentric link and the second eccentric link.

According to the exemplary embodiments of the present invention, it is possible to effectively change a compression ratio.

Further, the present invention has a simple structure and a simple assembling process, thereby reducing manufacturing costs.

In addition, effective operation may be achieved without disturbing the rotation of the crankshaft.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
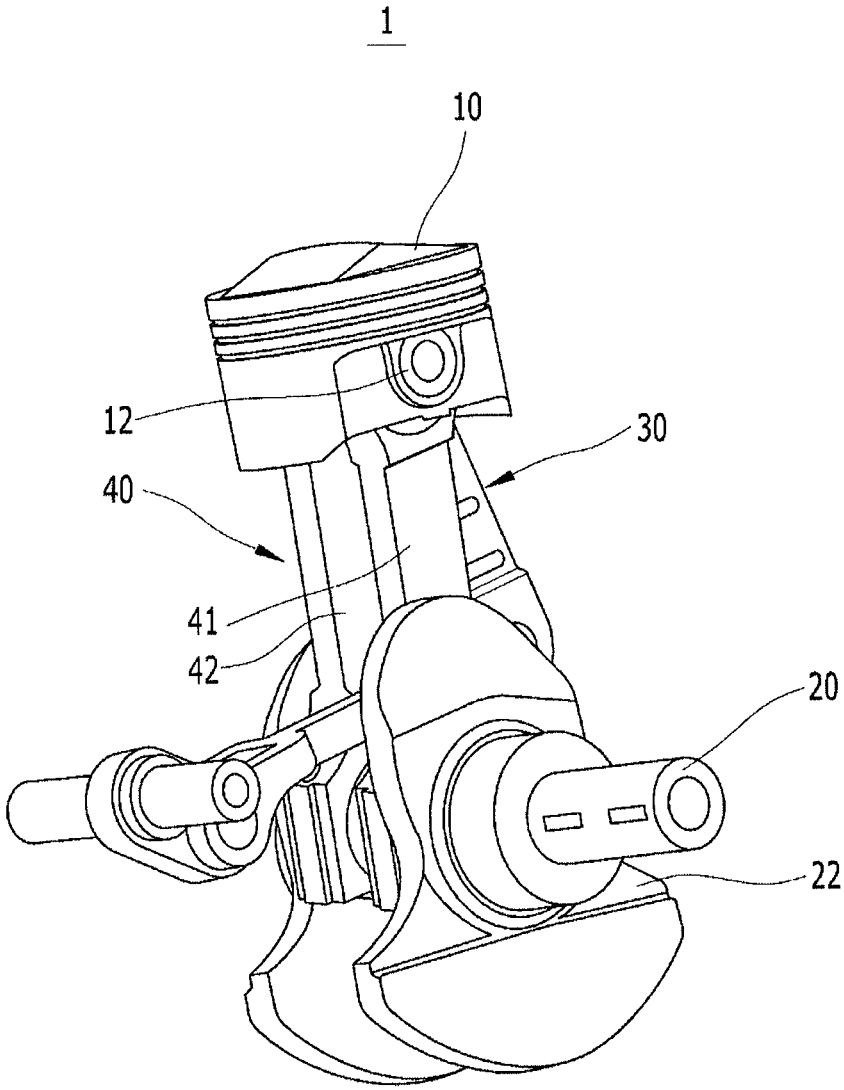
FIG. 1 is a perspective view schematically illustrating a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The present invention will be described more fully hereinafter with reference to the accompanying drawings, in which exemplary embodiments of the invention are shown.

As those skilled in the art would realize, the described embodiments may be modified in various different ways, all without departing from the spirit or scope of the present invention.

Figure 2:
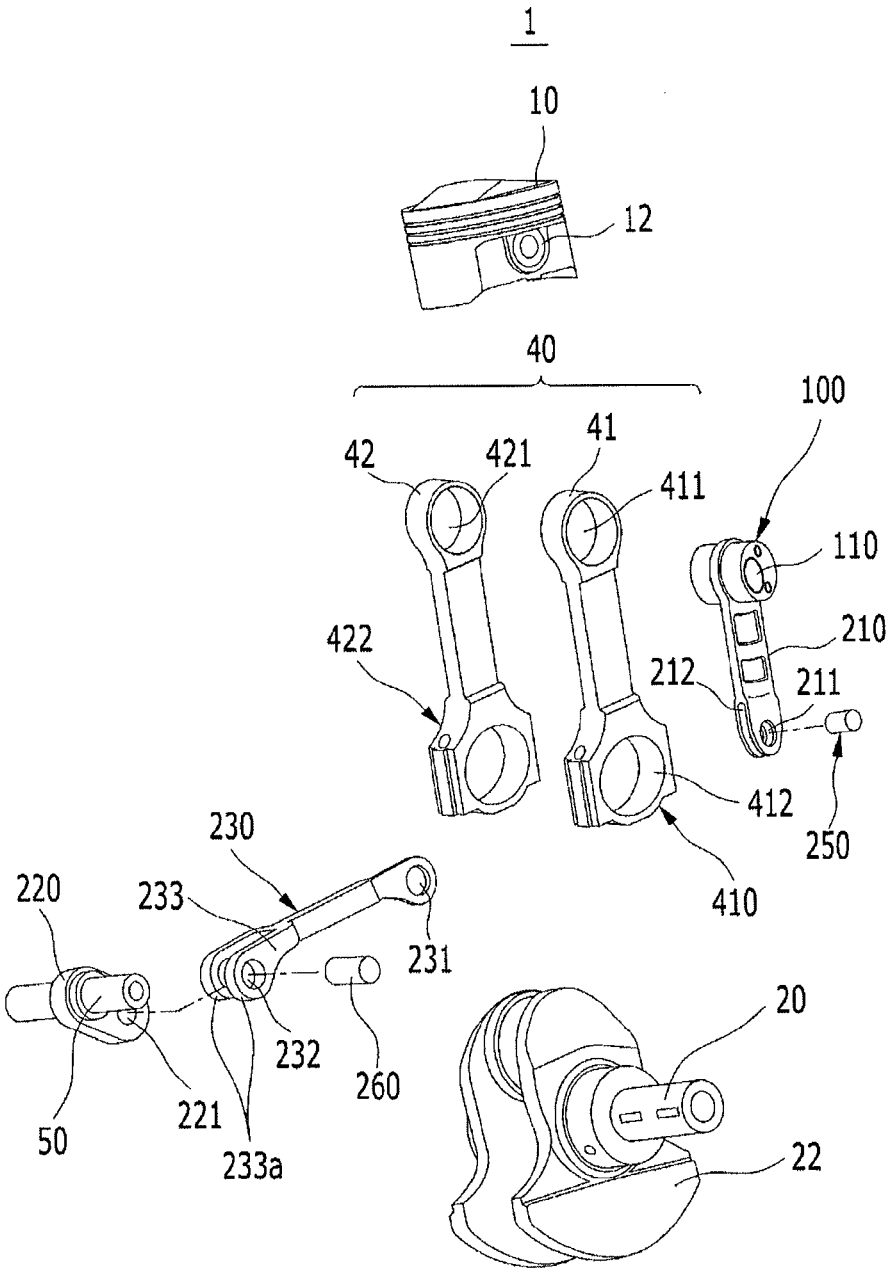
FIG. 2 is an exploded view schematically illustrating a variable compression ratio apparatus according to an exemplary embodiment of the present invention.
Figure 3:
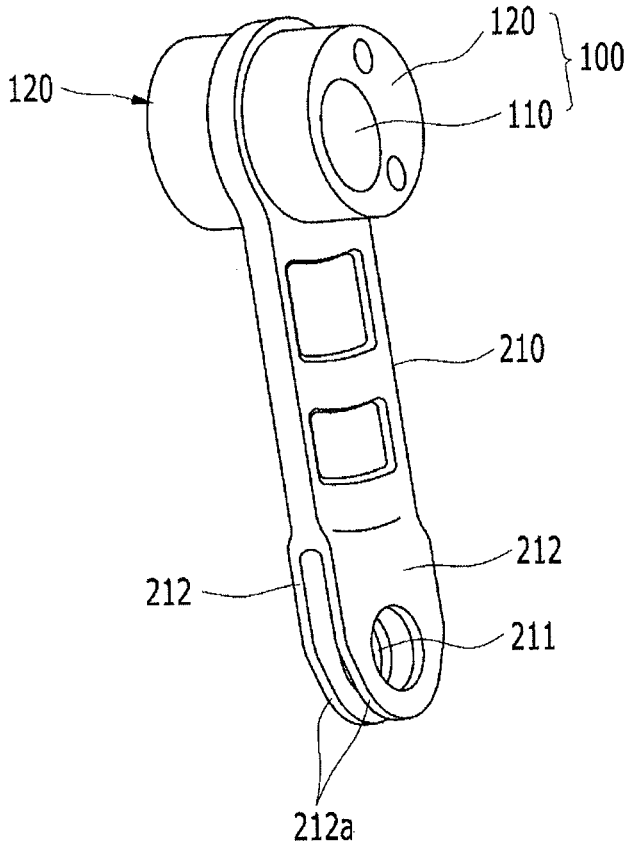
FIG. 3 is a perspective view illustrating a first eccentric link according to an exemplary embodiment of the present invention.
Figure 4:
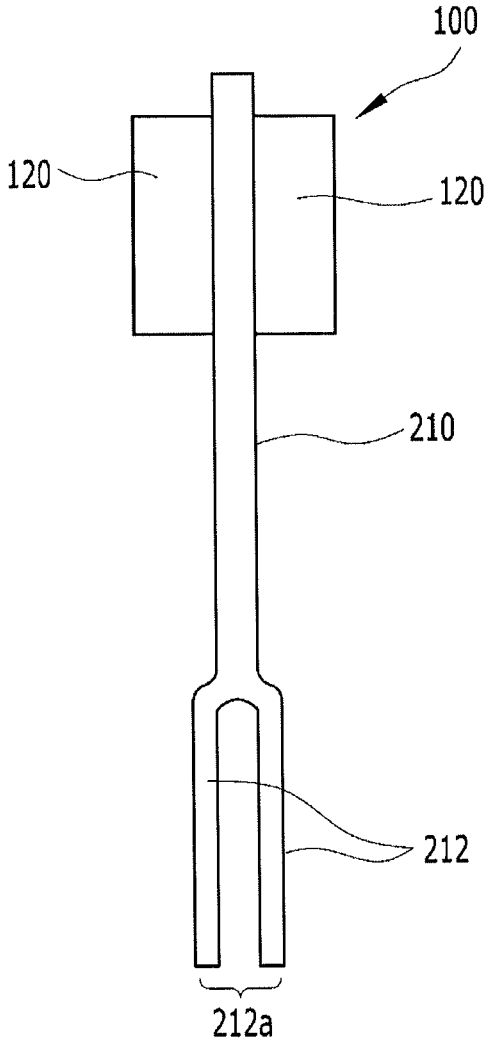
FIG. 4 is a side view illustrating a first eccentric link according to an exemplary embodiment of the present invention.
Figure 5:
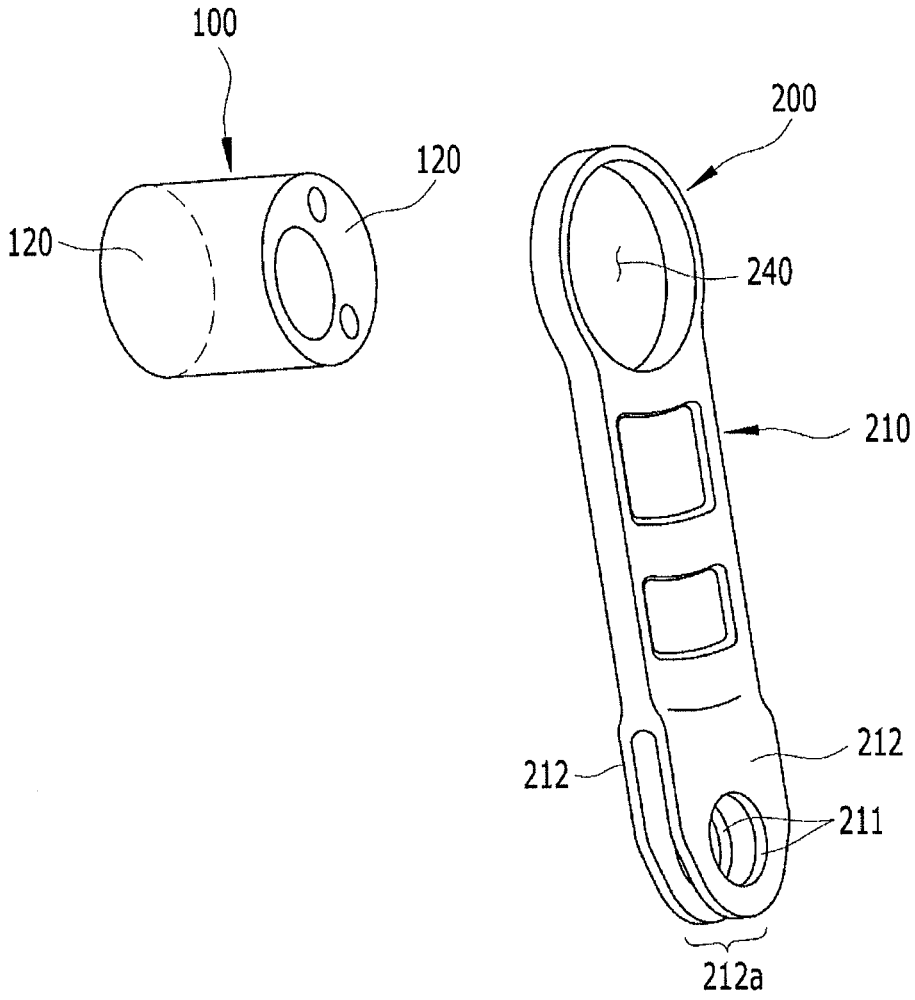
FIG. 5 is an exploded perspective view illustrating a first eccentric link according to an exemplary embodiment of the present invention.
Figure 6:
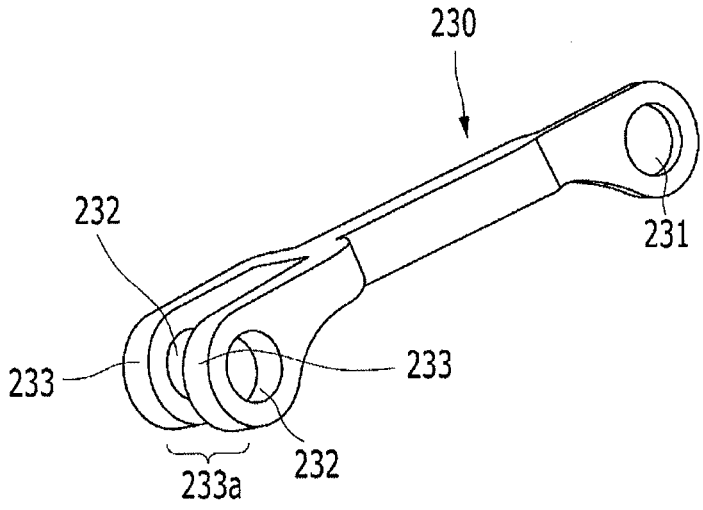
FIG. 6 is a perspective view illustrating a third eccentric link according to an exemplary embodiment of the present invention.
Figure 7:
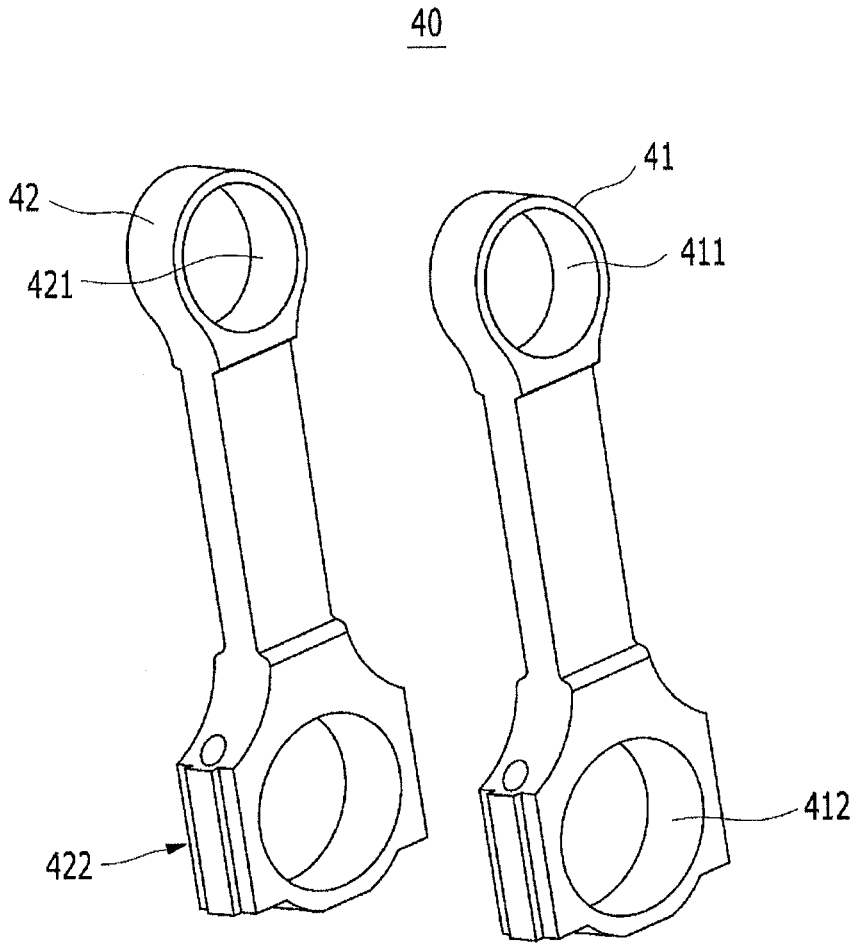
FIG. 7 is a perspective view illustrating a connecting rod according to an exemplary embodiment of the present invention.

FIG. 1 is a perspective view schematically illustrating a variable compression ratio apparatus according to an exemplary embodiment of the present invention, FIG. 2 is an exploded view schematically illustrating a variable compression ratio apparatus according to an exemplary embodiment of the present invention, FIG. 3 is a perspective view illustrating a first eccentric link according to an exemplary embodiment of the present invention, FIG. 4 is a side view illustrating a first eccentric link according to an exemplary embodiment of the present invention, FIG. 5 is an exploded perspective view illustrating a first eccentric link according to an exemplary embodiment of the present invention, FIG. 6 is a perspective view illustrating a third eccentric link according to an exemplary embodiment of the present invention, and FIG. 7 is a perspective view illustrating a connecting rod according to an exemplary embodiment of the present invention.

A variable compression ratio apparatus 1 according to an exemplary embodiment of the present invention is mounted in an engine for rotating a crankshaft 20 by receiving combustion force of mixed gas from a piston 10, and changes the compression ratio. The variable compression ratio apparatus 1 includes the piston 10, the crankshaft 20, an eccentric bearing assembly 30, a connecting rod 40, and a control shaft 50.

The piston 10 vertically moves inside a cylinder, and a combustion chamber is formed between the piston 10 and the cylinder.

The crankshaft 20 receives combustion force from the piston 10, converts the received combustion force to rotation force, and transfers the rotation force to a transmission. The crankshaft 20 is mounted inside a crank case formed at a lower end of the cylinder. Further, a plurality of balance weights 22 is mounted in the crank shaft 20. The balance weights 22 reduce rotational vibration generated during the rotation of the crankshaft 20.

The eccentric bearing assembly 30 is connected to the piston 10 through a piston pin 12, and changes a compression ratio by receiving rotation force of the control shaft 50 and adjusting a height of the piston 10 inside the cylinder.

Referring to FIGS. 2 to 4, the eccentric bearing assembly 30 includes an eccentric ring 100 and an eccentric link 200.

The eccentric ring 100 is provided in a ring shape including an eccentric hole 110 in which the piston pin 12 is eccentrically inserted within a body 110. The piston pin 12 is rotatable within the eccentric hole 120. However, the piston pin 12 is not limited thereto, and may be fixedly coupled with the eccentric ring 100.

The eccentric ring 100 includes both expanded portions 120 expanded to both sides with respect to an axial direction thereof. As illustrated in FIGS. 3 and 4, a first connecting rod 41 is coupled to the expanded portion 120 formed at one side with respect to the axial direction of the eccentric ring 100, and a second connecting rod 42 is coupled to the expanded portion 120 formed at the other side.

The eccentric link 200 is connected with the eccentric ring 100 to transfer rotation force to the eccentric ring 100.

The eccentric link 200 includes a first eccentric link 210, a second eccentric link 220, and a third eccentric link 230.

The first eccentric link 210 is connected to the eccentric ring 100.

The eccentric ring 100 is integrally formed with the first eccentric link 210, so that the eccentric ring 100 integrally rotates during the rotation of the eccentric link 200.

In one or multiple exemplary embodiments, FIGS. 3 and 4 illustrate an example in which the eccentric ring 100 is integrally formed with the first eccentric link 210. As illustrated in FIG. 4, the first eccentric link 210 is integrally formed with the eccentric ring 100 at a central portion of the eccentric ring 100, so that the expanded portions 120 of the eccentric ring 100 are formed at both sides of the first eccentric link 210.

In the meantime, as illustrated in FIG. 5, the eccentric link 200 and the eccentric ring 100 may be separately formed and coupled to each other.

FIG. 5 simply illustrates an exemplary embodiment in which the eccentric ring 100 is coupled with the first eccentric link 210 of the eccentric link 200. Accordingly, a method of coupling the eccentric ring 100 with the eccentric link 200 is not limited to the exemplary embodiment illustrated in FIG. 5, and the eccentric ring 100 may be coupled with the eccentric link 200 in various methods.

Referring to FIG. 5, an insertion opening 240 extending through in a circular shape is formed at one end of the first eccentric link 210 of the eccentric link 200, so that the eccentric ring 100 is inserted in and coupled to the insertion opening 240 by welding and the like.

The second eccentric link 220 is coupled to the control shaft 50. The second eccentric link 230 is rotated by rotation force of the control shaft 50. The second eccentric link 220 may be fixedly coupled to the control shaft 50, but is not limited thereto.

The third eccentric link 230 connects the first eccentric link 210 and the second eccentric link 220. The rotation force generated in the control shaft 50 is transferred to the first eccentric link 210 through the second eccentric link 220 and the third eccentric link 230, and the eccentric ring 100 is rotated by the rotation force transferred to the first eccentric link 210.

In the meantime, a first link hole 211 is formed at an end of the first eccentric link 210 opposite to the eccentric ring 100, a second link hole 231 is formed at an end of the third eccentric link 230, and the first eccentric link 210 may be coupled with the third eccentric link 230 by a first shaft member 250 inserted both the first link hole 211 and the second link hole 231. Here, a specific shape or disposition of the first link hole 211 or the second link hole 231 is not limited, so that the first link hole 211 and the second link hole 231 may be variously formed, such as a disposition while facing each other. FIGS. 2 to 4 illustrate an exemplary embodiment of a shape and disposition of the first link hole 211 and the second link hole 231.

Referring to FIGS. 3 and 4, in one or multiple exemplary embodiments, an end of the first eccentric link is branched to be formed as a pair of plates 212 facing each other with a predetermined interval 212*a*, and the first link holes 211 may be formed at the pair of plates 212, respectively.

An end of the third eccentric link 230 may be formed in a plate shape so as to be inserted in the interval 212*a* between the pair of plates 212. The end of the third eccentric link 230 is inserted in the interval 212*a* and then the first shaft member 250 is inserted in the first link hole 211 and the second link hole 231, so that the first eccentric link 210 is rotatably connected with the third eccentric link 230.

In the meantime, a third link hole 221 is formed at an end of the second eccentric link 220 opposite to the control shaft 50, a fourth link hole 232 is formed at the end of the third eccentric link corresponding to end of the second eccentric link 220, and the second eccentric link may be coupled with the third eccentric link by a second shaft member 260 inserted in the third link hole 221 and the fourth link hole 232.

FIG. 2 illustrates an exemplary embodiment in which the third link hole 221 is connected with the fourth link hole 232 by the second shaft member 260.

Referring to FIG. 2, in one or multiple exemplary embodiments, the end of the third eccentric link 230 is branched to be formed as a pair of branched portions 233 facing each other with a predetermined interval 233*a*, and the fourth link holes 232 may be formed at the pair of branched portions 233, respectively. The end of the second eccentric link 220 corresponding to the third eccentric link 230 is inserted in the interval 233*a* between the pair of branched portions, and the second shaft member 260 is inserted in the third link hole 221 and the fourth link hole 232 so that the third eccentric link 230 is connected with the second eccentric link 220.

The connecting rod 40 is a part for receiving combustion force from the piston 10 and transferring the combustion force to the crankshaft 20, and in an exemplary embodiment of the present invention, the connecting rod 40 includes a first connecting rod 41 and a second connecting rod 42 mounted at both sides of the eccentric ring 100.

Referring to FIGS. 1, 2, and 7, the first connecting rod 41 is rotatably installed in the expanded portion 120 at one side of the eccentric ring 100, and the second connecting rod 42 is rotatably installed in the expanded portion 120 at the other side of the eccentric ring 100.

Accordingly, as illustrated in FIG. 1, the eccentric bearing assembly 30 including the eccentric ring 100 rotates between the first connecting rod 41 and the second connecting rod 42 within a predetermined angle range.

In the meantime, one ends 411 and 421 of the first and second connecting rods 41 and 42 are formed as passing-through mounting holes 411 and 421 so that the expanded portions of the eccentric ring 120 are rotatably inserted therein, and the other ends 412 and 422 of the first and second connecting rods 41 and 42 are rotatably connected to the crankshaft 20 while being eccentric to the crankshaft 20.

Referring to FIGS. 1, 2, and 7, the first connecting rod 41 and the second connecting rod 42 may be formed in the same shape or a symmetric shape based on the eccentric bearing assembly 30.

The control shaft 50 is connected with the second eccentric link 210 to rotate the eccentric bearing assembly 30 as described above. A rotation angle of the control shaft 50 is changed according to a compression ratio. Accordingly, the eccentric bearing assembly 30 adjusts a height of the piston 10 according to a change in the rotation angle of the control shaft 50. The control shaft 50 may be provided in parallel to the crankshaft 20. However, the control shaft 50 is not limited thereto, and may be provided at various positions according to a design.

The variable compression ratio apparatus 1 according to the exemplary embodiment of the present invention may further include a controller. The controller changes a compression ratio of the mixed gas according to an operation condition of the engine. To this end, the controller rotates the control shaft 50 through a driving means, such as a motor.

Further, the aforementioned variable compression ratio apparatus 1 rotates the eccentric ring through the connection with the first to third eccentric links, but is not limited thereto, and the eccentric links may be variously combined.

In addition, the form, in which the respective eccentric links 210, 220, and 230 of the aforementioned variable compression ratio apparatus 1 are coupled by the shaft members 250 and 260, and the shaft members are inserted in the eccentric links so that the eccentric links are coupled, is suggested, but the respective eccentric links are not limited thereto, and may be coupled in various forms.

Furthermore, in the aforementioned variable compression ratio apparatus 1, the eccentric ring 100 and the first eccentric link 210 may be integrally formed as illustrated in FIGS. 3 and 4 or may be coupled as illustrated in FIG. 5, and may further be coupled by various methods.

Figure 8:
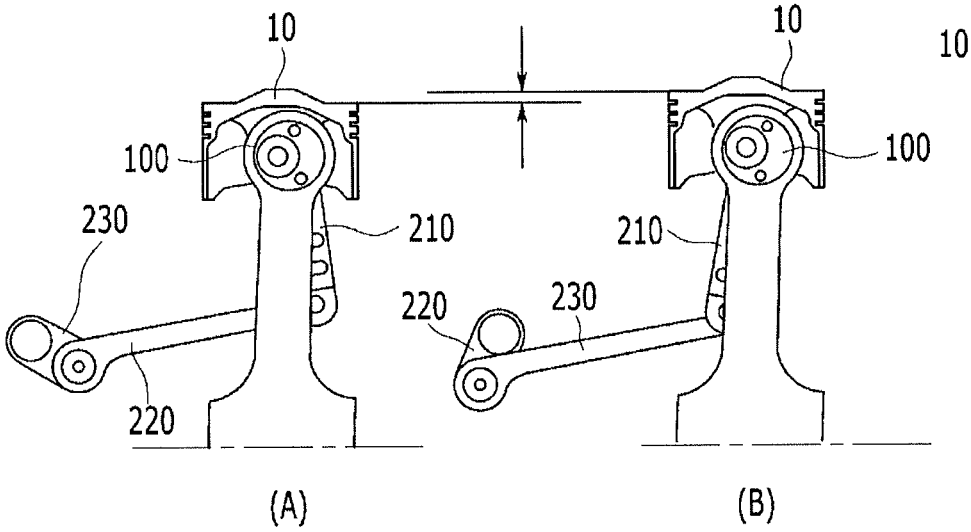
FIG. 8 is a schematic view of comparison between a low compression ratio operation condition and a high compression ratio operation condition of a variable compression ratio apparatus according to an exemplary embodiment of the present invention.
Figure 9:
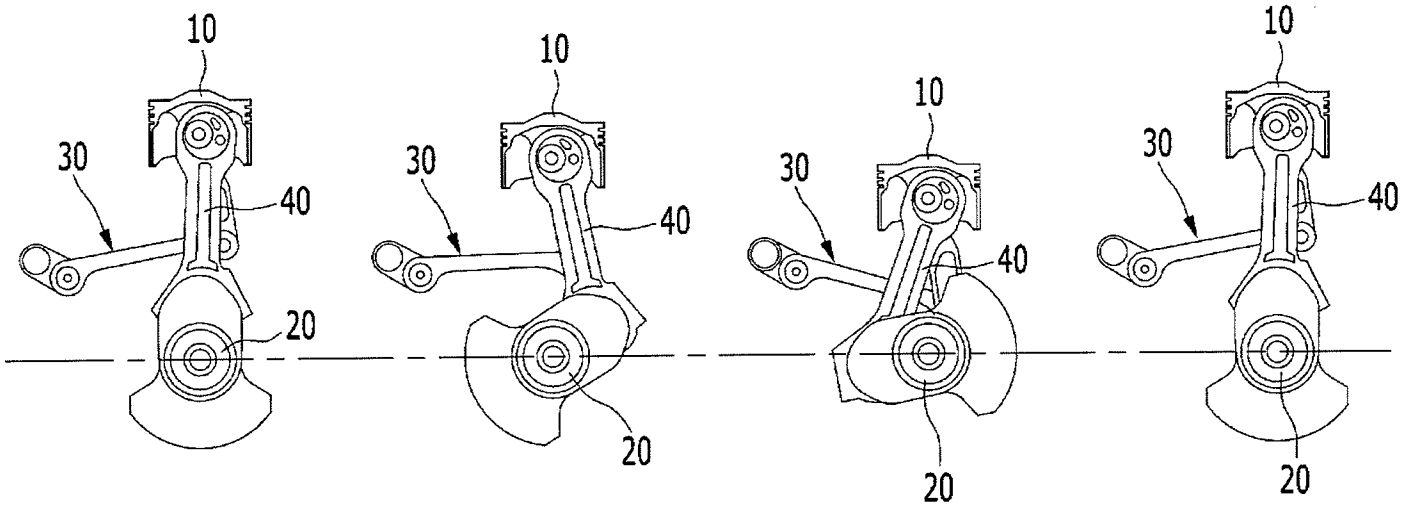
FIG. 9 is a schematic view illustrating an operation state of a variable compression ratio apparatus according to an exemplary embodiment of the present invention.

FIG. 8 is a schematic view of comparison between a low compression ratio operation condition and a high compression ratio operation condition of the variable compression ratio apparatus according to an exemplary embodiment of the present invention, and FIG. 9 is a schematic view illustrating an operation state of the variable compression ratio apparatus according to an exemplary embodiment of the present invention.

Hereinafter, an operation of the variable compression ratio apparatus according to the exemplary embodiment of the present invention will be described in detail with reference to FIGS. 8 and 9.

Referring to FIG. 8, when the controller determines a compression ratio of the mixed gas according to an operation condition of the engine, whether to rotate the control shaft 50 and an angle of the rotation of the control shaft 50 are determined. Accordingly, whether to rotate the second eccentric link 220 and an angle of the rotation of the second eccentric link 220 are determined according to whether to rotate the control shaft 50 and the angle of the rotation of the control shaft 50. When the second eccentric link is rotated, the third eccentric link 230 and the first eccentric link 210 are rotated, and thus the eccentric ring 100 is rotated and a height of the piston 10 is changed. That is, when the crankshaft 20 is positioned at the same position, the height of the piston 10 is changed according to the compression ratio.

Specifically, in the variable compression ratio apparatus 1, when the control shaft 50 is rotated in a clockwise direction in a low compression ratio operation condition A, the second eccentric link 220 turns in the clockwise direction to pull the third variable link 230. Accordingly, the first eccentric link 210 rotates in the clockwise direction and a position of the piston pin 12 is raised. Accordingly, a distance between the piston pin 12 and a crank pin is increased, so that a high compression ratio operation condition B is implemented.

Further, contrary to this, in the variable compression ratio apparatus 1, when the control shaft 50 is rotated in a counterclockwise direction in the high compression ratio operation condition B, the second eccentric link 220 turns in the counterclockwise direction to push the third eccentric link 230. Accordingly, the first eccentric link 210 rotates in the counterclockwise direction and a position of the piston pin 12 is lowered. Accordingly, a distance between the piston pin 12 and a crank pin is decreased, so that the low compression ratio operation condition A is implemented.

According to the aforementioned process, the eccentric bearing assembly 30 is positioned according to the determined compression ratio. Referring to FIG. 9, an angle of the second eccentric link 220 is determined according to the rotation of the control shaft 50, and the first eccentric link 210 connected to the eccentric ring 100 is inter-rotated with the third eccentric link 230 connected to the first eccentric link 210 during the rotation of the crankshaft 20, so that the eccentric bearing assembly 30 according to the exemplary embodiment of the present invention adjust the height of the piston 10, thereby implementing a high compression ratio or a low compression ratio.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus mounted on an engine receiving combustion force of mixed gas from a piston to rotate a crankshaft, and configured to change a compression ratio of the mixed gas, the apparatus comprising:

an eccentric bearing assembly engaged with the piston through a piston pin, and including:

an eccentric ring having an eccentric hole so that the piston pin is rotatably installed therethrough while being eccentric to the eccentric ring; and an eccentric link connected to the eccentric ring to transfer rotation force to the eccentric ring;

a first connecting rod rotatably installed at a one side in an axial direction of the eccentric ring;

a second connecting rod rotatably installed at the other side in the axial direction of the eccentric ring; and a control shaft connected to the eccentric link to rotate the eccentric bearing assembly by transferring the rotation force to the eccentric ring, wherein the eccentric ring includes expanded portions at both sides in the axial direction thereof so that the first and second connecting rods are rotatably installed at the expanded portions, respectively, and wherein one ends of the first and second connecting rods are formed with mounting holes respectively, the expanded portions being rotatably inserted therein, and the other ends of the first and second connecting rods are rotatably connected to the crankshaft while being eccentric to the crankshaft.

2. The variable compression ratio apparatus of claim 1, wherein the eccentric ring is integrally formed with the eccentric link.

3. The variable compression ratio apparatus of claim 1, wherein the eccentric ring is separately provided from the eccentric link to be coupled with the eccentric link.

4. The variable compression ratio apparatus of claim 3, wherein an insertion opening passing through in a circular shape is formed at one end of the eccentric link, so that the eccentric ring is inserted in and coupled with the insertion opening.

5. The variable compression ratio apparatus of claim 1, wherein the eccentric link includes:

a first eccentric link connected to the eccentric ring;

a second eccentric link connected to the control shaft; and a third eccentric link pivotally connecting the first eccentric link and the second eccentric link.

6. The variable compression ratio apparatus of claim 5, wherein a first link hole is formed at an end of the first eccentric link opposite to the eccentric ring, and a second link hole is formed at an end of the third eccentric link, and wherein the first eccentric link is pivotally coupled with the third eccentric link by a first shaft member inserted in both the first link hole and the second link hole.

7. The variable compression ratio apparatus of claim 6, wherein the end of the first eccentric link is branched and formed as a pair of plates facing each other with a predetermined interval, and first link holes are formed at the pair of plates, respectively, and wherein the end of the third eccentric link is inserted in the interval between the pair of plates, and the first shaft member is inserted in the first link holes and the second link hole to be coupled with the end of the first eccentric link.

8. The variable compression ratio apparatus of claim 5, wherein a third link hole is formed at an end of the second eccentric link opposite to the control shaft, and a fourth link hole is formed at the other end of the third eccentric link, and wherein the second eccentric link is pivotally coupled with the third eccentric link by a second shaft member inserted in both the third link hole and the fourth link hole.

9. The variable compression ratio apparatus of claim 8, wherein the other end of the third eccentric link is branched and formed as a pair of branched portions facing each other with a predetermined interval, and fourth link holes are formed at the pair of branched portions, respectively, and wherein the end of the second eccentric link is inserted in the interval between the pair of branched portions, and the second shaft member is inserted in the third link hole and the fourth link hole to be coupled with the other end of the third eccentric link.

10. A variable compression ratio apparatus configured to change a compression ratio of mixed gas flowing in a cylinder of an engine according to an operation condition of the engine, the apparatus comprising:

a piston slidably moving inside the cylinder;

a crankshaft provided at a lower end of the cylinder to be rotated by a reciprocal movement of the piston;

a balance weight connected to the crank shaft and configured to reduce vibration generated during a rotation of the crank shaft;

an eccentric ring engaged with the piston through a piston pin, and including an eccentric hole formed therein so that the piston pin is rotatably installed therethrough while being eccentric to the eccentric ring;

an eccentric link connected with the eccentric ring to transfer rotation force to the eccentric ring;

a first connecting rod rotatably installed at a one side in an axial direction of the eccentric ring;

a second connecting rod rotatably installed at the other side in the axial direction of the eccentric ring; and a control shaft pivotally connected to the eccentric link to rotate the eccentric ring, wherein one ends of the first and second connecting rods are formed with mounting holes respectively, the expanded portions being rotatably inserted therein, and the other ends of the first and second connecting rods are rotatably connected to the crankshaft while being eccentric to the crankshaft.

11. The variable compression ratio apparatus of claim 10, wherein the eccentric link includes:

a first eccentric link connected to the eccentric ring;

a second eccentric link connected to the control shaft; and a third eccentric link pivotally connecting the first eccentric link and the second eccentric link.

* * * * *